United States Patent [19]

Weber

[11] 4,198,891

[45] Apr. 22, 1980

[54] CIRCUIT FOR SIMULATING SOUNDS OF PERCUSSIVE INSTRUMENTS

[75] Inventor: Christopher M. Weber, Alsip, Ill.

[73] Assignee: CBS Inc., New York, N.Y.

[21] Appl. No.: 895,318

[22] Filed: Apr. 11, 1978

[51] Int. Cl.[2] ..... G10H 1/02; G10H 5/04

[52] U.S. Cl. ..... 84/1.03; 84/1.22; 84/1.26; 84/DIG. 12

[58] Field of Search ..... 84/1.03, 1.11–1.13, 84/1.19–1.24, 1.26, DIG. 12

[56] References Cited

U.S. PATENT DOCUMENTS

| | | | |
|---|---|---|---|
| 3,493,569 | 4/1969 | Dobbs et al. | 84/1.26 |
| 3,636,801 | 1/1972 | Ichikawa | 84/1.13 |
| 3,971,283 | 7/1976 | Wayne, Jr. | 84/1.26 |
| 3,973,461 | 8/1976 | Jahns | 84/1.24 |

*Primary Examiner*—S. J. Witkowski
*Attorney, Agent, or Firm*—Spencer E. Olson

[57] ABSTRACT

An electronic circuit for simulating the sound of a skin head percussive instrument struck with a stick includes a pair of ringing oscillators of different frequencies both triggered by pulses from the rhythm pattern generator of an electronic organ, a circuit for combining the output signals from the two ringing oscillators in preselected amplitude proportions, and a circuit for distorting the combined signal in such a way as to non-linearly amplify the combined signal so as to produce an electrical signal having characteristics such that when acoustically reproduced produces a sound highly simulative of that produced when the membrane of a skin head instrument is struck with a stick.

11 Claims, 2 Drawing Figures

CIRCUIT FOR SIMULATING SOUNDS OF PERCUSSIVE INSTRUMENTS

BACKGROUND OF THE INVENTION

This invention relates to electronic musical instruments, and is more particularly concerned with an electronic circuit for use in an electronic organ for simulating the sound produced when a skin head instrument, such as a tom-tom, is struck with a stick.

In the evolutionary development of electronic organs, musical devices have been developed which automatically produce repetitive rhythms for accompaniment with the organ. Such automatic rhythm pattern generators have, in turn, stimulated the development of a variety of electrically produced sounds, the sources of which are often spoken of as "instruments." For example, modern automatic repetitive rhythm devices may include "instruments" producing sounds that may contain a great many frequencies but that have no pitch characteristics, such as drums, cymbals, wood blocks, tom-toms, tambourines, etc. Some of such "instruments" in current commercial use quite closely simulate the sound of the corresponding real instrument, but others either do not provide musically acceptable simulation or are expensive to implement and/or inconvenient to use. Currently available instruments for simulating the sound of skin head instruments, such as tom-toms and bongos, of which applicant is aware do not mimic the real instruments as realistically as desired.

It is the primary object of the present invention to economically produce electrically a sound simulative of that produced when the head of a skin head percussive instrument is struck with a stick.

BRIEF DESCRIPTION OF THE INVENTION

Briefly, the object of the invention is achieved with a system including at least two ringing oscillators both of which are periodically triggered simultaneously by pulses derived from the rhythm pattern generator of an electronic organ. The ringing oscillators are designed to generate decaying sinusoids of different frequencies, one of which corresponds to the apparent overall pitch of the percussive instrument to be simulated and the other of which is of a frequency to enrich the tonal quality of the final sound. The signals generated by the ringing oscillators are combined in predetermined amplitude proportions and applied to a circuit designed to distort the combined signal in a manner to introduce such additional harmonics that when the resulting distorted signal is reproduced in the loudspeaker of the organ a sound highly simulative of that produced when the percussive instrument is struck is produced.

BRIEF DESCRIPTION OF THE DRAWINGS

Other objects, features and advantages of the invention will become apparent, and its construction and operation better understood, from the following detailed description taken in conjunction with the accompanying drawings in which.

DESCRIPTION OF THE PREFERRED EMBODIMENT

Figure 1:
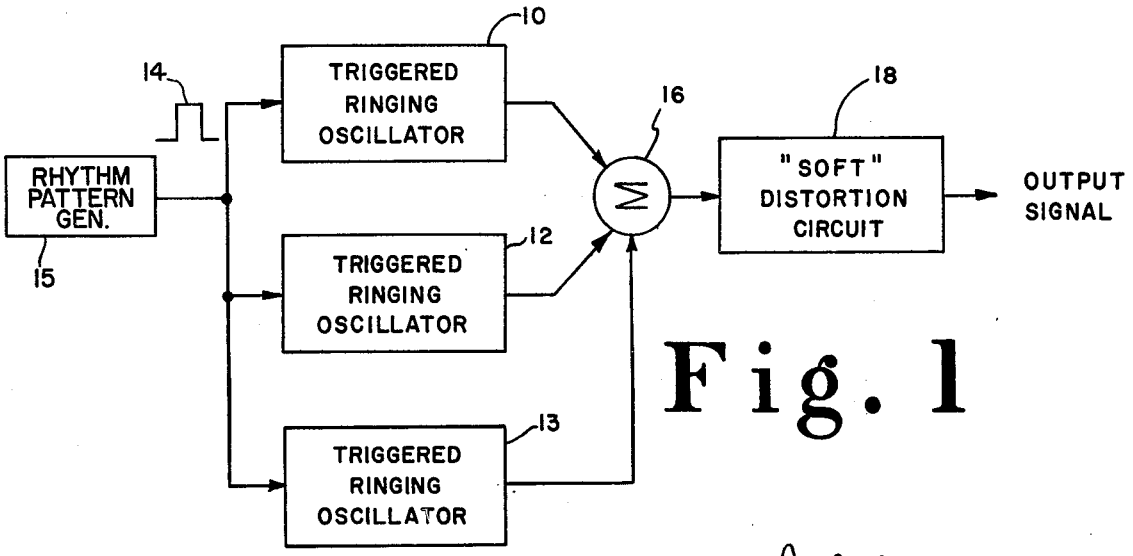
FIG. 1 is a general block diagram of a circuit embodying the invention.

Referring to FIG. 1, the instrument according to the invention, which will be described as applied to a high-pitched tom-tom, consists essentially of at least two triggered ringing oscillators 10 and 12 each operative to produce an oscillating output voltage signal which decreases in amplitude with time. The frequency-determining components of the oscillators are so selected that one generates a frequency that corresponds to the apparent overall pitch of the tom-tom, hereinafter referred to as the fundamental, and the other generates a signal of a frequency usually higher than that of the fundamental, to enrich the tonal quality of the final sound produced by the instrument. Both oscillators are simultaneously triggered periodically by pulses from the rhythm pattern generator 15 of the electronic organ in which the instrument is incorporated, the rhythm pattern generator providing activating signals to the percussion voicing circuits of the organ at predetermined times. For example, a bass drum might be activated at the downbeat of each measure, with the tom-tom activated at the occurrence of the second full note following the downbeat. Thus, both oscillators are triggered together at times controlled by the rhythm pattern selected by the instrumentalist, and when triggered each produces an oscillating voltage which decays in amplitude with time.

The two oscillatory signals are combined in predetermined amplitude proportions in a summing device 16 which produces at its output a complex signal which decreases in amplitude with time. The output signal from the summing device is applied to a signal-modifying circuit 18 characterized as a "soft distortion" circuit. This circuit is designed to distort the combined signal in such a way as to introduce in the output signal harmonics of one or both of the two generated frequencies, and cross-modulation products of the two generated frequencies, which output signal when acoustically reproduced simulates the sound of a struck tom-tom. In particular, circuit 18 produces a type of slew-rate related distortion and a type of amplitude distortion, the combined effect of which is to non-linearly amplify the combined signal and produce frequencies in the output signal which are not present at the input. The exact nature of the distortion is unknown and does not lend itself to rigorous mathematical analysis, but as will be seen from the description to follow, frequency components in addition to the frequencies of the two oscillators are introduced which enrich the tonal quality of the output signal.

The frequencies of the two oscillators were selected empirically by careful listening testing of an actual tom-tom played by a professional drummer and observing the characteristics of the sound signal. Another factor in the selection of the two oscillator frequencies is the relationship with the frequencies of other rhythm "instruments" incorporated in the organ in which it is to be used. It was also empirically determined that the interval between the pitch and the pitch of the second oscillatory signal is desirably between a fifth and a sixth, and that depending upon the particular percussive instrument being simulated, may be either above or below the frequency of the fundamental. As one example, (others will be discussed later) a fundamental frequency of about 139 Hz, which is near $C\#_3$ on the piano scale, and a second signal having a frequency of about 225 Hz, which is near A#3 on the piano scale, when combined and distorted as described results in a signal which when acoustically reproduced closely simulates the sound produced when a high-pitched tom-tom is struck with a stick. Since the frequency of the fundamental is empirically selected, its frequency may differ within a limited range from the specific indicated frequency.

Figure 2:
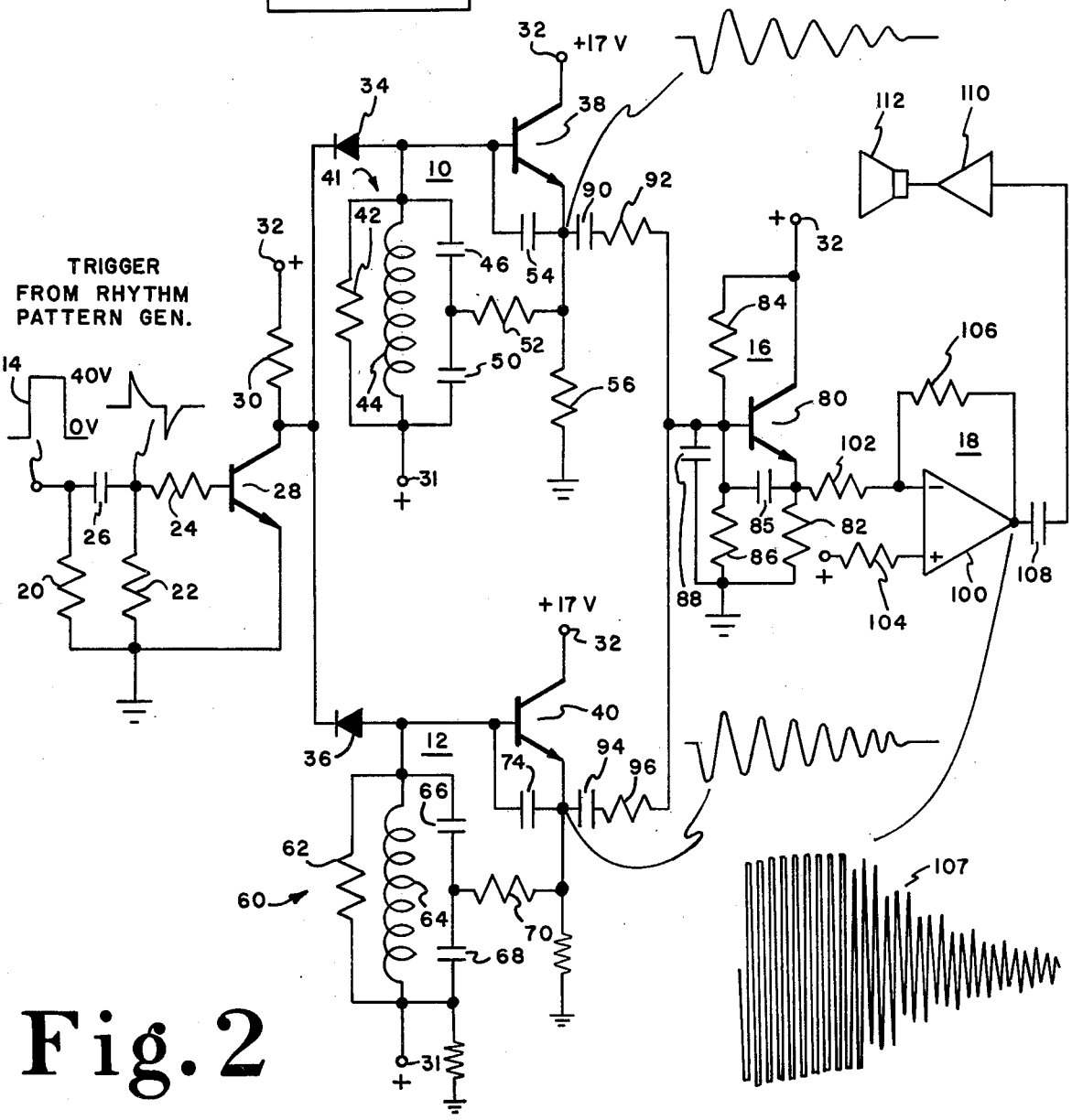
FIG. 2 is a schematic circuit diagram of a preferred embodiment of the invention.

FIG. 2 is a circuit diagram of a specific implementation of the invention that has been successfully operated, and includes two ringing oscillators 10 and 12 which are triggered together by periodically occurring pulses 14 from the rhythm pattern generator of the organ in which the system is used. The trigger pulses typically may have a duration of the order of 20 to 60 milliseconds and an amplitude of 4.0 to 5.0 volts. The trigger pulses are applied through an RC network consisting of resistors 20, 22 and 24 and a capacitor 26 to the base electrode of an NPN transistor 28, the collector electrode of which is connected through a resistor 30 to a source of positive potential represented by terminal 32, and the emitter electrode of which is connected to ground. The components of the RC circuit have values selected to produce across resistor 22 positive-going and negative-going spikes at the leading and trailing edges, respectively, of the trigger pulse. The positive-going spike, typically having an amplitude of about 3.0 volts, causes transistor 28 to saturate, the value of resistor 30 being such that the voltage at the collector electrode is reduced from the potential of source 32, typically +72 volts, to approximately +0.4 volt or less for a period of the order of one to five milliseconds.

The collector electrode of transistors 28 is connected through diodes 34 and 36 to the base electrode of oscillator transistors 38 and 40, respectively, the collector electrode of both of which is directly connected to the potential source 32. Oscillator 10 further includes a tuned tank circuit 41 including a resistor 42 connected in parallel with an inductor 44, and series-connected capacitors 46 and 50 connected across the parallel combination. This tank circuit is connected between the base and emitter electrodes of transistor 38, the junction between capacitors 46 and 50 being connected through a resistor 52 to the emitter electrode. The other terminal of the tank circuit is connected to a source of positive potential, represented by terminal 31, having a potential one-half that of source 32, or +8.5 volts. Also connected between the base and emitter electrodes is a capacitor 54, and the emitter electrode is connected to ground through a resistor 56.

Similarly, oscillator 12 includes a tuned tank circuit 60 consisting of a resistor 62 and an inductor 64 connected in parallel and series-connected capacitors 66 and 68 connected in parallel with the RL components, the junction between the capacitors being connected through a resistor 70 to the emitter electrode of transistor 40. The emitter electrode of transistor 40 is connected to ground through a resistor 72 and also to the base electrode through capacitor 74. The other terminal of the tank circuit is connected to potential source 31.

It will be recognized that the described oscillators are of the Colpitts type, and known in the art as a Q-multiplier; although its operation is well-known, for the sake of completeness it will be described in the context of this particular application. When the potential at the collector electrode of transistor 38 is reduced to near zero for a period of the order of one to five milliseconds following application of a trigger pulse, diodes 34 and 36 are forward-biased and allow current to flow from both of tank circuits 41 and 60 through the transistor to ground, thus effectively unloading energy from the tank circuits. When the voltage at the collector of transistor 38 agains rises to its quiescent level, current flow in inductors 44 and 64 is stopped; however, since the current in the inductors cannot stop instantaneously it continues to flow in the LC circuits, thus charging the associated capacitors, causing a voltage to build up across the capacitors and slowly stopping the current. Then the capacitors discharge through the inductors, reversing the direction of current flow, and as this process continues an oscillating voltage appears across each of the tank circuits. As the oscillations continue, their energy is slowly dissipated by losses in the circuit, causing the oscillations to decrease in amplitude. Positive feedback injected into the tank circuits by resistors 52 and 70 respectively connected to the emitter electrodes of transistors 38 and 40 controls the rate of damping and thus the decay period of the sinusoidal output signals. In a system designed to simulate the sound of a high-pitched tom-tom, the circuit values of oscillator 10 are selected to produce a signal having a frequency of about 139 Hz, which essentially corresponds to the apparent overall pitch of this class of tom-tom, and the circuit values of oscillator 12 are chosen to produce a higher second frequency, typically about 225 Hz, the interval between the fundamental and the second frequency being between the fifth and sixth. The resistance values of feedback resistors 52 and 70 are so related to the values of other circuit components that the duration of the decaying oscillatory signals appearing at the emitter electrode of transistors 38 and 40 are approximately 100 milliseconds and 60 milliseconds, respectively.

These two oscillatory signals are combined in preselected amplitude proportions in a summing circuit 16 including an NPN transistor 80, the collector electrode of which is connected to potential source 32 and the emitter of which is connected through a resistor 82 to ground. The base electrode is connected through resistor 84 to potential source 32 and through resistor 86 to ground, and also through capacitor 88 to ground. A capacitor 85 is connected between the base and emitter electrodes to suppress parasitic oscillations that may be generated in the circuit. The signal developed at the emitter of transistor 38 is applied to the base electrode of transistor 80 through a capacitor 90 connected in series with resistor 92, and the signal developed at the emitter electrode of transistor 40 is injected into the base electrode of transistor 80 through a capacitor 94 connected in series with a resistor 96. The relative values of capacitors 90 and 94 and resistors 92 and 96 are such that the amplitudes of the fundamental and the second signal applied to transistor 80 are in the ratio of approximately 7.4:1. The values of the circuit components associated with transistor 80 are such as to produce at its emitter a complex oscillatory signal representing the sum of the indicated amplitude proportions of the two generated signals, characterized by a decaying envelope having a duration of approximately 100 milliseconds.

This complex signal is applied to a signal-distorting circuit 18 designed to distort the combined signal in such a way as to introduce such additional harmonics to the combined signal as will cause the resulting distorted signal when acoustically reproduced to closely simulate the sound produced when a tom-tom is struck with a stick. Because of its electrical characteristics, especially its slew rate and its soft distortion quality, the illustrated "Norton" amplifier is particularly suitable for achieving the desired output signal. The signal appearing at the emitter of transistor 80 is applied through a resistor 102 to the inverting input of an operational amplifier 100; the non-inverting input of amplifier 100 is connected through a resistor 104 to a source of positive potential, typically having a value of 15 to 20 volts, and a feedback resistor 106 is connected between the output terminal of the amplifier and the inverting input. Resistors 104 and 106 have relative values to cause the amplifier to operate with a gain of approximately forty-five. By way of example, amplifier 100 may take the form of one of the four circuits on an LM3900 quad operational amplifier integrated circuit chip. Because of the limited slew-rate of this type of amplifier for large signal operation, it does not perfectly reproduce the input signal; rather, the large signal excursions of the applied signal cause the amplifier to operate in a non-linear region, resulting in both amplitude and slew-rate distortion. The total effect of this distortion is complex and not readily amenable to mathemetical analysis, but the result is that it introduces in the output signal harmonics not present in the complex input signal. In an operational embodiment of the system, the signal appearing at the output of amplifier 100 has the waveshape illustrated at 107. It will be noted that approximately the initial one-third of the waveform is hard-limited, thereby causing generation of a higher order harmonics and intermodulation products (not shown in the illustration), and that for the remaining approximately two-thirds it has a decaying envelope and consists essentially of the sum of fractional portions of the fundamental and second signals. The intermodulation products occurring in the first one-third of waveform 107 would include the sum and difference of all the frequencies applied to the amplifier, and the higher order harmonics would include harmonics of the fundamental and the second frequency and harmonics of the intermodulation products. This waveform has characteristics closely similar to the sound waveform produced when a high-pitched tom-tom is struck with a stick; that is, it is rich in harmonics for a short period following strike and then dies out at approximately an exponential rate with an apparent overall pitch.

The distorted signal is coupled through a capacitor 108 to a suitable output amplifier 110 for application to a loudspeaker 106 of the electronic organ. When the distorted signal is acoustically reproduced, it realistically simulates the sound produced when the membrane of a tom-tom is struck with a stick.

While some variation from the following values is allowable, it has been found that the circuitry of the invention if constructed according to the values listed below will produce a complex signal which when reproduced will realistically simulate a high-pitched tom-tom:

| | |
|---|---|
| Capacitors | |
| 26 | .047 mfd |
| 46 | .27 mfd |
| 50 | .27 mfd |
| 54 | 150 mfd |
| 90 | .068 mfd |
| 66 | .10 mfd |
| 68 | .10 mfd |
| 74 | 150 pfd |
| 94 | .0068 mfd |
| 88 | .047 mfd |

-continued

| | |
|---|---|
| 108 | 1.0 mfd |
| Resistors | |
| 20 | 47K |
| 22 | 22K |
| 24 | 56K |
| 30 | 4.7K |
| 42 | 150K |
| 52 | 10K |
| 56 | 6.8K |
| 62 | 270K |
| 70 | 22K |
| 72 | 6.8K |
| 82 | 6.8K |
| 84 | 47K |
| 86 | 47K |
| 92 | 180K |
| 96 | 1.5M |
| 102 | .22K |
| 104 | 2.2M |
| 106 | 1.0M |
| Transistors | |
| 28 | 2N3860 |
| 38 | 2N3860 |
| 40 | 2N3860 |
| 80 | 2N3860 |
| Diodes | |
| 34 | 1N4148 |
| 36 | 1N4148 |
| Inductors | |
| 44 | 10 henry |
| 64 | 10 henry |

Although the specific implementation of the invention for producing the effect of a high-pitched tom-tom has been described, the circuit of FIG. 2 with suitable modification of its frequency-determining elements can be used to simulate other skin head instruments, including the low-pitched tom-tom and low and high congas. Typical fundamental and second frequencies for these instruments are set forth in the following Table I;

| Instrument | Fund. Freq. (Hz) | Second Freq. (Hz) |
|---|---|---|
| Lo tom-tom | 86.3 | 137 |
| Lo conga | 184 | 273 |
| Hi conga | 250 | 392 |

The circuit of FIG. 2 will produce the required frequencies when the values of the components of the Q-multiplier have the values listed in the following table, it being understood that these are the only components having values different from those listed above. Both ringing oscillators having the same circuit configuration, for convenience the reference numerals applicable to the frequency-determining elements of ringing oscillator 10 are used to identify the components.

TABLE III

| | | Component Values | | | | | |
|---|---|---|---|---|---|---|---|
| Instrument | (Hz) Freq. | (h) L44 | (uf) C48 | (uf) C50 | R52 | R42 | (uf) C94 |
| LO TOM-TOM | 86.3 | 10 | .68 | .68 | 4.7K | 150K | .68 |
| | 137.0 | 10 | .27 | .27 | 10K | 270K | .15 |
| LO CONGA | 184 | 1 | 1.5 | 1.5 | 82K | 15K | 4.7 |
| | 273 | 10 | .068 | .068 | 27K | 270K | 3.3 |
| HI CONGA | 250 | 1 | 1.0 | .68 | 1.2K | 33K | 3.3 |

TABLE III-continued

| Instrument | (Hz) Freq. | Component Values (h) L44 | (uf) C48 | (uf) C50 | R52 | R42 | (uf) C94 |
|---|---|---|---|---|---|---|---|
| | 392 | 1 | .33 | .33 | 2.7K | 100K | 3.3 |

By using an additional ringing oscillator 13 having frequency-determining components to produce a decaying oscillatory signal properly related in frequency to the frequencies of the other two, combining them in appropriate amplitude proportions, and distorting the combined signal as described, the system of the invention can also be used to simulate low and high bongos and the snare drum. Typical fundamental and additional frequencies for simulating these instruments are set forth in the following Table II:

TABLE II

| Instrument | Fund. Freq. (Hz) | Second Freq. (Hz) | Third Freq. (Hz) |
|---|---|---|---|
| Lo Bongo | 301 | 581 | 822 |
| Hi Bongo | 392 | 712 | 1040 |
| Snare Drum | 205 | 152 | 433 |

It will be noted that in the case of the snare drum one of the additional signals is higher and the other is lower in frequency than the fundamental frequency.

A system comprising three ringing oscillators 10, 12 and 13 each having the configuration shown for oscillators 10 and 12 in FIG. 2 and the Q-multiplier component values listed in the following table will produce respective output signals having the specified frequencies which combined in amplitude proportions determined by value of the output capacitor of each (i.e., capacitor 90 for oscillator 10 and capacitor 94 for oscillator 12) and the combined signal distorted as described, will produce electro-acoustic signals simulative of the listed instruments. Again, for convenience, the reference numerals applicable to the frequency-determining elements of oscillator 10 are used in the table to identify the components.

TABLE IV

| Instrument | (Hz) Freq. | Component Values (h) L44 | (uf) C48 | (uf) C50 | R52 | R42 | (uf) C94 |
|---|---|---|---|---|---|---|---|
| LO BONGO | 301 | 10 | .056 | .056 | 33K | 270K | 4.7 |
| | 581 | 1.0 | .15 | .15 | 5.6K | 150K | 3.3 |
| | 822 | 0.5 | .15 | .15 | 5.6K | 120K | 2.2 |
| HI BONGO | 392 | 10 | .033 | .033 | 47K | 330K | .033 |
| | 712 | 10 | .01 | .0082 | 100K | 1.2M | .033 |
| | 1040 | 1.0 | .047 | .047 | 22K | 1M | .033 |
| SNARE | 205 | 10 | .1 | .1 | 15K | 120K | 1.5 |
| DRUM | 152 | 10 | .22 | .22 | 10K | 120K | 2.2 |
| | 433 | 1.0 | .27 | .27 | 4.7K | — | 1.0 |

I claim:

1. In an electronic organ including a rhythm pattern generator for producing a predetermined sequence of trigger pulses, and a loudspeaker, apparatus for producing an electrical signal which when reproduced by said loudspeaker simulates the sound produced when a skin head percussive instrument is struck, said apparatus comprising:

at least first and second ringing oscillators connected to be simultaneously triggered into oscillation by trigger pulses from said rhythm pattern generator and respectively operative to produce at least first and second decaying sinusoidal signals having frequencies differing by a predetermined musical interval, first circuit means for combining said at least first and second sinusoidal signals in predetermined amplitude proportions to produce a combined signal, and second circuit means for distorting said combined signal and producing an output electrical signal containing frequency components not contained in said combined signal which when reproduced simulates the sound of a skin head percussive instrument.

2. Apparatus according to claim 1, wherein the frequencies of said at least first and second sinusoidal signals differ by between a fifth interval and a sixth interval.

3. Apparatus according to claim 2 for simulating the sound of a high-pitched tom-tom, wherein the frequencies of said at least first and second sinusoidal signals are about 139 Hz and about 225 Hz, respectively.

4. Apparatus according to claim 3, wherein said combining means combines said at least first and second sinusoidal signals in amplitude proportions of about 7.4:1.

5. Apparatus according to claim 2 for simulating the sound of a low-pitched tom-tom, wherein said at least first and second ringing oscillators produce sinusoidal signals having frequencies of about 86 Hz and 137 Hz, respectively.

6. Apparatus according to claim 2 for simulating the sound of a low-pitched conga, wherein said at least first and second ringing oscillators produce sinusoidal signals having frequencies of about 184 Hz and 273 Hz, respectively.

7. Apparatus according to claim 2 for simulating the sound of a high-pitched conga, wherein said at least first and second ringing oscillators produce sinusoidal signals having frequencies of about 250 Hz and 392 Hz, respectively.

8. Apparatus according to claim 2 for simulating the sound of a low-pitched bongo, including first, second and third ringing oscillators, and wherein said first, second and third ringing oscillators produce sinusoidal signals having frequencies of about 310 Hz, 581 Hz and 822 Hz, respectively.

9. Apparatus according to claim 2 for simulating the sound of a high-pitched bongo, including first, second and third ringing oscillators, and wherein said first, second and third ringing oscillators produce sinusoidal signals having frequencies of about 392 Hz, 712 Hz and 1040 Hz, respectively.

10. Apparatus according to claim 2 for simulating the sound of a snare drum, including first, second and third ringing oscillators, and wherein said first, second and third ringing oscillators produce sinusoidal signals having frequencies of about 205 Hz, 152 Hz and 433 Hz, respectively.

11. Apparatus according to claim 2, wherein said signal distorting means comprises an amplifier operative to produce both amplitude and slew-rate distortion of said combined signal.

* * * * *